US005598180A

United States Patent [19]

Suzuki et al.

[11] Patent Number: 5,598,180

[45] Date of Patent: Jan. 28, 1997

[54] ACTIVE MATRIX TYPE DISPLAY APPARATUS

[75] Inventors: Kouhei Suzuki; Kouji Suzuki, both of Yokohama, Japan

[73] Assignee: Kabushiki Kaisha Toshiba, Kawasaki, Japan

[21] Appl. No.: 29,323

[22] Filed: Mar. 4, 1993

[30] Foreign Application Priority Data

Mar. 5, 1992 [JP] Japan ..... 4-048313

[51] Int. Cl.[6] ..... G09G 3/36

[52] U.S. Cl. ..... 345/100; 345/211; 345/96

[58] Field of Search ..... 340/784, 811, 340/805; 345/211, 212, 208, 209, 210, 98, 213, 100, 99, 94, 95, 96, 87; 359/54, 55

[56] References Cited

U.S. PATENT DOCUMENTS 4,356,483 10/1982 Fujita et al. ..... 340/805
4,702,560 10/1987 Endo et al. ..... 340/784
5,093,655 3/1992 Tanioka et al. ..... 340/784
5,119,085 6/1992 Yamazaki ..... 340/784

OTHER PUBLICATIONS

Takubo, et al., Proceedings of the 9th International Display Research Conference (Japan Display '89), Oct. 1989, pp. 584–587.

*Primary Examiner*—Richard Hjerpe
*Assistant Examiner*—Xiao M. Wu
*Attorney, Agent, or Firm*—Oblon, Spivak, McClelland, Maier & Neustadt, P.C.

[57] ABSTRACT

An active-matrix type liquid-crystal display comprising a matrix display panel including a glass substrate, pixel electrodes formed on the substrate, signal lines formed on the substrate, gate lines formed on the substrate, and switching elements formed on the substrate, signal-line drive ICs for applying signal voltages to the signal lines, and gate-line drive ICs for driving the switching elements. The display further comprises power-supply potential control circuits for changing the first and second power-supply potentials (VDD, VSS) of the signal-line drive ICs, each by a predetermined value, in accordance with the signal voltages to be applied to the pixel electrodes.

15 Claims, 6 Drawing Sheets

ACTIVE MATRIX TYPE DISPLAY APPARATUS

BACKGROUND OF THE INVENTION

1. Field of the Invention

The present invention relates to an active-matrix type display apparatus comprising a display substrate, switching semiconductor elements formed in the substrate, and memory elements formed in the substrate, for storing signals. More particularly, it relates to an active-matrix type display apparatus whose signal lines are driven by an improved method.

2. Description of the Related Art

An active-matrix type liquid-crystal display is attracting attention. It is regarded as a display which can be modified into a flat-panel display or a high-definition projection TV screen, which displays high-quality images comparable with those displayed by a cathode-ray tube (CRT). A liquid-crystal display of this type comprises a display substrate, pixels formed on the substrate, signal lines for setting the pixels at specified potentials, gate lines, signal lines for selecting the pixels to be energized, a signal-line drive circuit for driving the signal lines, and a gate-line drive circuit for driving the gate lines.

Both drive circuits are integrated circuits (ICs). The signal-line drive IC which is operated by an intermediate-voltage power supply, e.g., a power-supply system of 12V or more, in consideration of the voltage applied to the liquid crystal and the method used to drive the signal lines and the gate lines. This is because, although it suffices to apply a voltage of 5V (absolute value) to the liquid crystal, the signal lines need to be driven at 2 to 12V (7V±5V), while setting the common electrode at 7V, for example, in order to drive the liquid crystal with an AC current.

In recent years it is demanded that the drive frequency be increased to achieve high-definition dislay by using a great number of pixels, the signal-line drive IC and the liquid-crystal panel be made at low cost, and the singal-line drive IC be one which can be driven by a 5V power-supply system and thus can be made small. Proposed as a method in which a 5V-drive IC is drive signal lines is the so-called "common inversion drive." In this method, the voltage applied to the common electrode is altered, repeatedly, each time in accordance with the polarity of the voltage applied to the liquid crystal.

In order to accomplish high-definition display, it is desirable that each signal line and one pixel electrode be spaced apart as little as possible. However, the shorter the distance between the signal line and the pixel electrode, the greater the capacitance crosstalk between them. If the crosstalk is too large, there will be a luminance difference between the upper and lower parts of the display screen, inevitably degrading the quality of the image displayed. To prevent the image-quality degradation, it is proposed that the 5V -drive IC drive the signal lines in another method generally known as "signal-line inversion drive," in which any two adjacent signal lines are set at opposite polarities, thereby to prevent the image-quality degradation.

The common inversion drive method cannot be performed along with the signal-line inversion drive method in which any two adjacent signal lines are set at opposite polarities. Consequently, it is difficult to use a 5V-drive IC, which has a low withstand voltage, in order to display high-quality images. Thus it is difficult to reduce the power-supply voltage for the drive IC and to prevent an image-quality degradation which may results from the capacitance crosstalk between each signal line.and any pixel electrode.

SUMMARY OF THE INVENTION

The object of the present invention is to provide a display apparatus in which a drive IC performs the signal-line inversion drive method, thereby preventing an image-quality due to the capacitance crosstalk between each signal line and any pixel electrode, and in which the power-supply voltage for the signal-line drive IC can be decreased.

According to a first aspect of the invention, there is provided an active-matrix type display apparatus which comprises a matrix display panel including a substrate having a major surface, a plurality of signal lines formed on the major surface of the substrate, and a plurality of gate lines formed on the major surface of the substrate and extending at right angles to the signal lines; a gate-line drive circuit for applying a gate-drive voltage to each of the gate lines; and a signal-line drive circuit to be operated by a first power-supply potential (VDD) and a second power-supply potential (VSS), for applying a signal voltage to each signal line, which is inverted in polarity at predetermined intervals. The apparatus further comprises a power-supply potential control circuit for changing the first power-supply potential (VDD) and the second power-supply potential (VSS) by a predetermined value in accordance with the polarity of the signal voltage.

According to a second aspect of the invention, there is provided an active-matrix type display apparatus which comprises a matrix display panel including a substrate having a major surface, a plurality of signal lines formed on the major surface of the substrate, and a plurality of gate lines formed on the major surface of the substrate and extending at right angles to the signal lines; a gate-line drive circuit for applying a gate-drive voltage to each of the gate lines; and a signal-line drive circuit to be operated by a first power-supply potential (VDD) and a second power-supply potential (VSS), for applying a signal voltage to each signal line, which is inverted in polarity for each frame or each field. The apparatus further comprises a power-supply potential control circuit for changing the first power-supply potential (VDD) and the second power-supply potential (VSS) by a predetermined value in accordance with the polarity of the signal voltage.

According to a third aspect of this invention, there is provided an active-matrix type display apparatus which comprises a matrix display panel including a substrate having a major surface, a plurality of signal lines formed on the major surface of the substrate, and a plurality of gate lines formed on the major surface of the substrate and extending at right angles to the signal lines; a gate-line drive circuit for applying a gate-drive voltage to each of the gate lines; and a signal-line drive circuit to be operated by a first power-supply potential (VDD) and a second power-supply potential (VSS), for applying two signal voltages which are of opposite polarities, each inverted in polarity at predetermined intervals, to any adjacent two of the signal lines, respectively. The apparatus further comprises a power-supply potential control circuit for changing the first power-supply potential (VDD) and the second power-supply potential (VSS) by a predetermined value every time the signal voltages are inverted in polarity.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The present invention will now be described, with reference to the embodiments shown in the accompanying drawings.

Figure 1:
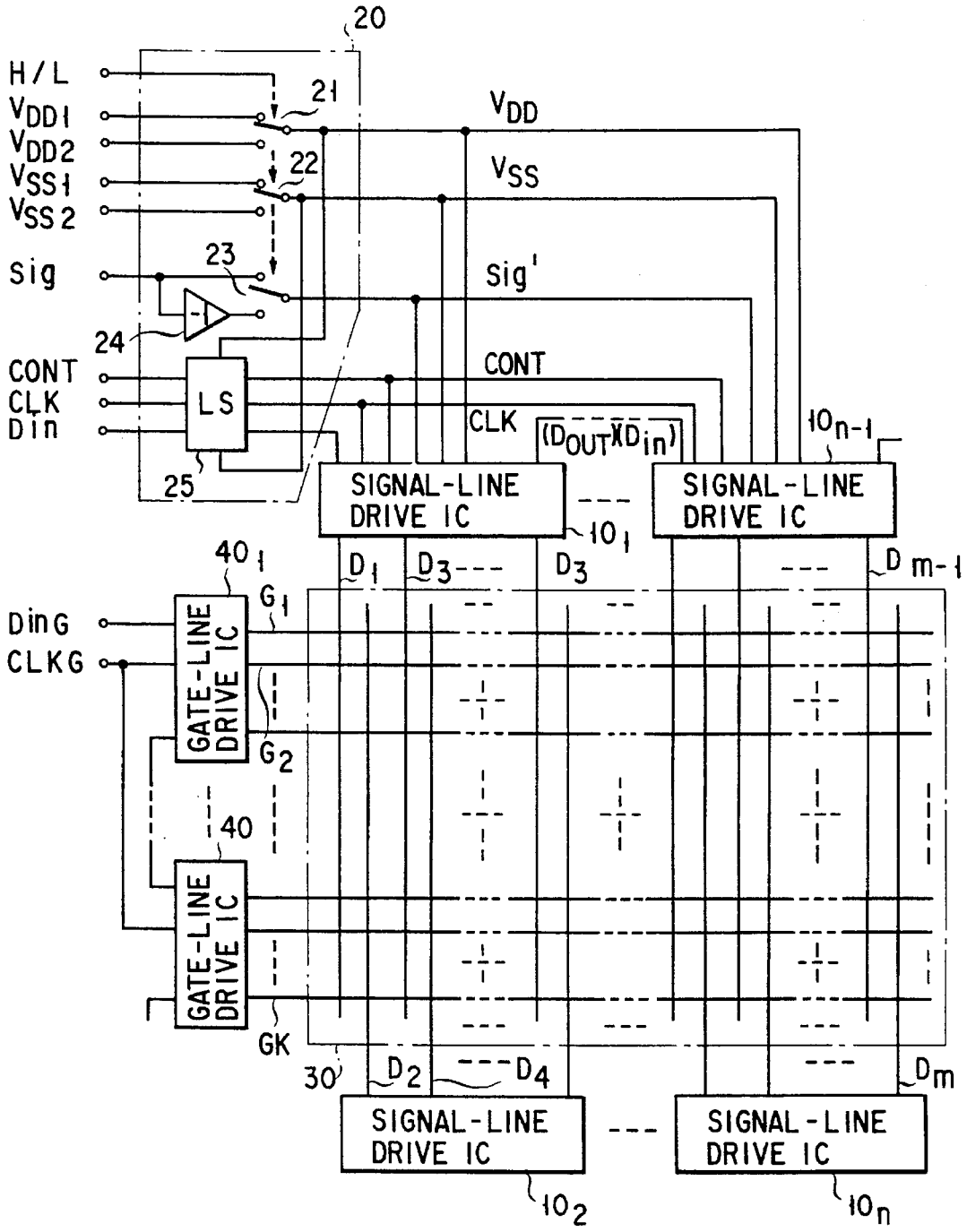
FIG. 1 is a block diagram showing a liquid-crystal display which is a first embodiment of this invention.

FIG. 1 is a block diagram showing an active-matrix type liquid-crystal display which is the first embodiment of the invention. This display comprises signal-line drive ICs $\mathbf{10}_l$ to $\mathbf{10}_n$, two power-supply potential control circuits 20 and 20' (only the circuit 20 shown), a matrix substrate 30, and gate-line drive ICs $\mathbf{40}_l$ to $\mathbf{40}_l$.

Figure 2:
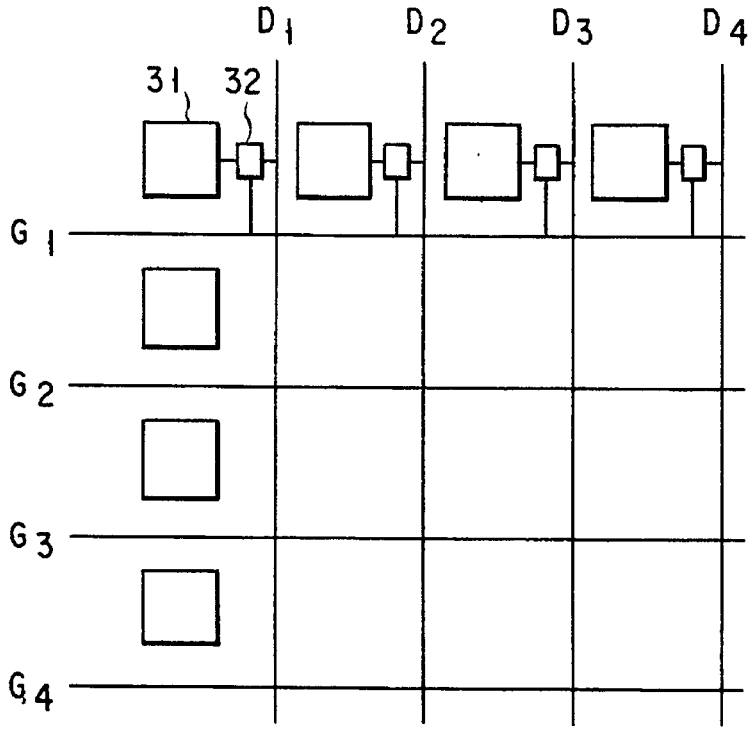
FIG. 2 is a plan view showing the matrix substrate of the display shown in FIG. 1.

As shown in FIGS. 1 and 2, the matrix substrate 30 comprises a substrate of glass or the like, pixel electrodes 31 arranged on the substrate in rows and colunms, signal lines $D_l$ to $D_m$ arranged on the substrate and exetending among the columns of pixel electrodes 31, gate lines $G_l$ to $G_k$ arraned on the substrate and extending among the rows of pixel electrodes 31 and, hence, at right angles to the signal lines $D_l$ to $D_m$, and switching elements 32, such as MOS transistors, each connected to one pixel electrode 31, one signal line D and one gate line G.

The matrix substrate 30 further comprises a common electrode (not shown) which is spaced apart from the glass substrate or the like, and opposes the pixel electrodes 13. The gap between the substrate and the common electrode is filled with liquid crystal. Hence, a layer of liquid crystal is formed, covering the pixel electrodes 31, the switching elements 32, the signal lines $D_l$ to $D_m$, and the gate lines $G_l$ to $G_k$.

Figure 4:
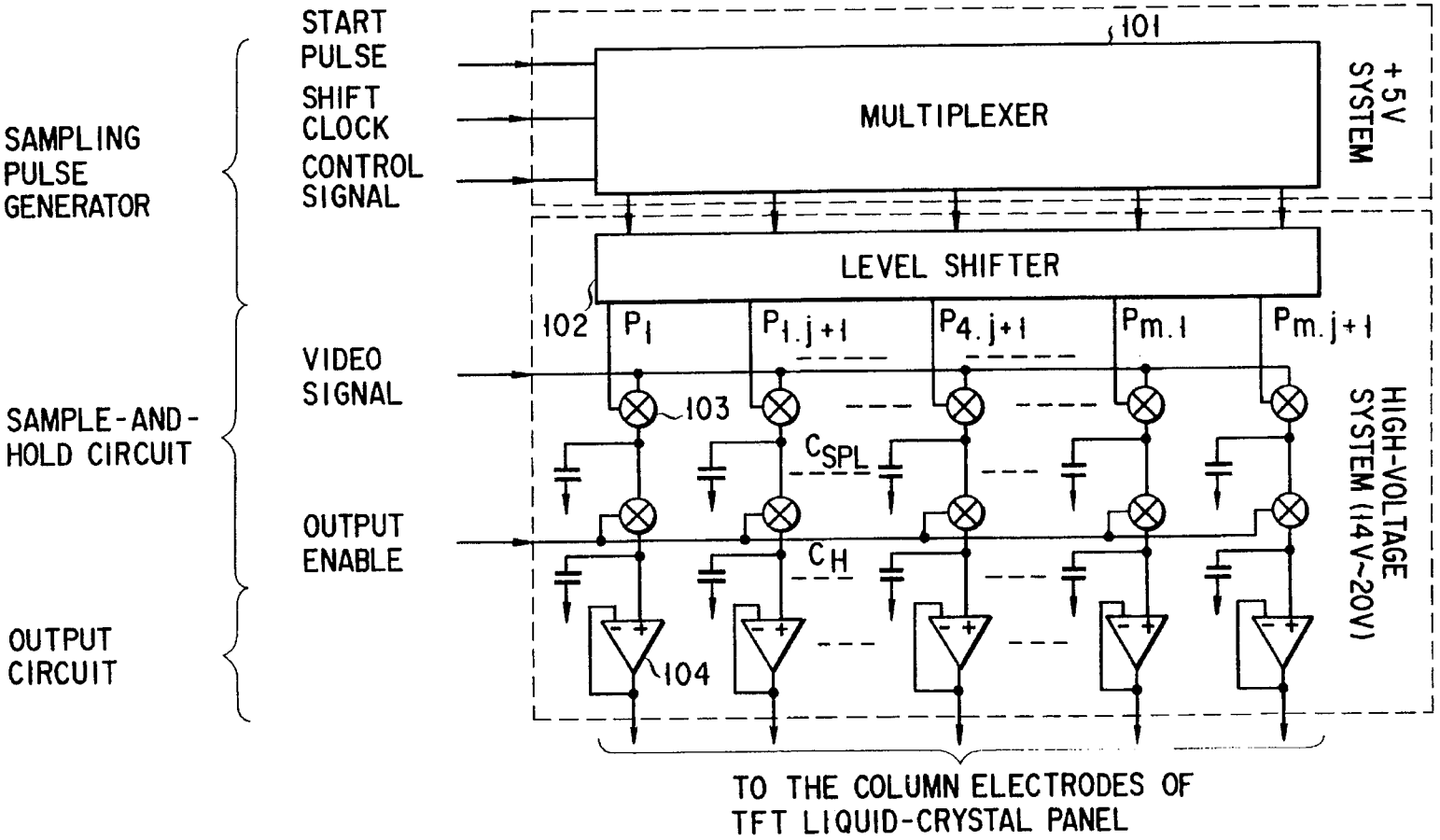
FIG. 4 is a circuit diagram showing the signal-line drive IC used in the display of FIG. 1.

As is shown in FIG. 4, each signal-line drive IC 10 is of the known type which has a sampling pulse generator, a sample-and-hold circuit, and the like. More specifically, the drive IC 10 comprises a multiplexer 101, a level shifter 102, analog switches 103, operational amplifiers 104, sampling capacitors $C_{SPL}$, and hold capacitors $C_H$.

As is shown in FIG. 1, of the signal lines $D_l$ to $D_m$ are formed on the glass substrate, the odd-numbered ones $D_l$, $D_3, \ldots D_{m-1}$ are connected to the signal-line drive ICs $\mathbf{10}_l$, $\mathbf{10}_3, \ldots \mathbf{10}_{n-1}$ which are arranged along the first row of pixel electrodes 31. The other signal lines, i.e., the even-numbered signal lines $D_2, D_4, \ldots D_m$, are connected to the signal-line drive ICs $\mathbf{10}_2, \mathbf{10}_4, \ldots \mathbf{10}_n$ which are arranged along the last row of pixel electrodes 31. Each of the $\mathbf{10}_1, \mathbf{10}_3, \ldots \mathbf{10}_{n-1}$ has two power-supply potential terminals VDD and VSS and four signal terminals Sig, CONT, CLK and Din, all connected to the first power-supply potential control circuit 20. Similarly, each of the $\mathbf{10}_2, \mathbf{10}_4, \ldots \mathbf{10}_n$ has two power-supply potential terminals VDD and VSS (not shown) and four signal terminals Sig, CONT, CLK and Din (not shown), all connected to the second power-supply potential control circuit 20' (not shown, either). The gate lines $G_1$ to $G_k$, formed on the glass substrate, are connected to the gate-line drive ICs $\mathbf{40}_l$ to $\mathbf{40}_l$.

The active-matrix type liquid-crystal display shown in FIG. 1 may be one designed for a XGA system. If so, the display has 1024 signal lines, 768 gate lines, four signal-line drive ICs each having 256 outputs, and three gate-line drive ICs each having 256 outputs. Also, the display may be one designed for a HDTV system. In this case, the display has 1920 signal lines, 1024 gate lines, eight signal-line drive ICs each having 256 outputs, and four gate-line drive ICs each having 256 outputs.

The power-supply potential control circuits 20 and 20' change the power-supply potentials VDD and VSS and the signals Sig., CONT, CLK and Din for every frame of an image, each from a high level H to a low level L or vice versa, in response to a power-supply potential switching signal (H/L). The control circuits 20 and 20' are opposite in terms of level-switching logic. The control circuit 20 switches either power-supply potential and any signal from the high level H to the low level L, and the control circuit 20' changes the same power-supply potential and the same signal from the low level L to the high level H—in response to the same power-supply potential switching signal (H/L).

Figure 3:
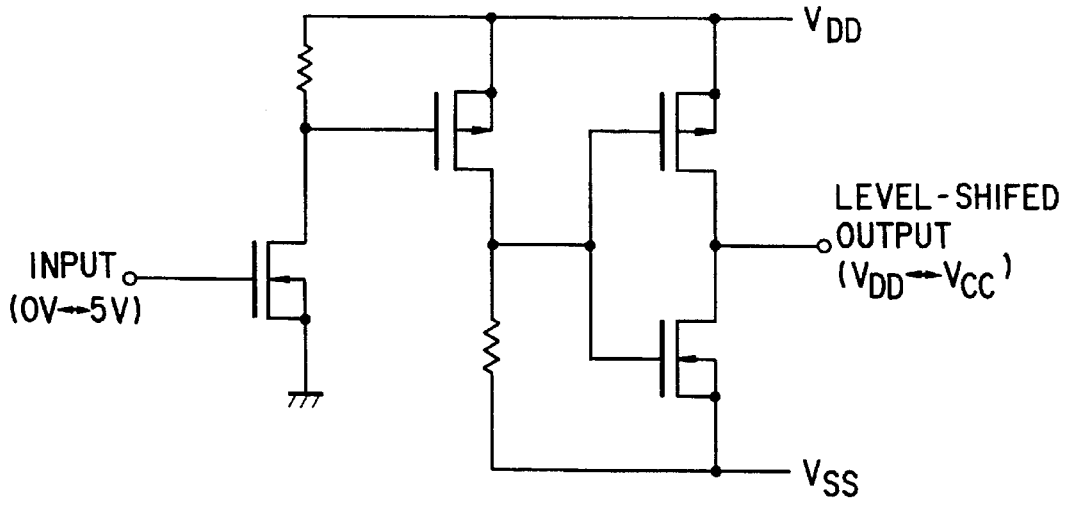
FIG. 3 is a circuit diagram of the level shifter incorporated in the display of FIG. 1.

As is shown in FIG. 1, the control circuit 20 comprises analog switches 21, 22 and 23 which are, for example, MOS transistors, an inverting amplifier 24, and three level shifters 25. The analog switches 21, 22 and 23 are operated by the switching signal (H/L), setting the power-supply potentials VDD and VSS and the image display signal Sig at the high level H or the low level, for each signal-line drive IC 10. The signal Sig is either a signal output by an image display signal generator (not shown) or a signal the inverting amplifier 24 has generated by inverting and amplifying the output signal of the signal generator. The level shifters 25 shift the levels of the signals CONT, CLK and Din, respectively, within the range predetermined for the signal-line drive IC 10. The level shifters 25 have the identical structure illustrated in FIG. 3.

Although not shown in FIG. 1, the second control circuit 20' has the same structure as the first control circuit 20, comprising analog switches 21', 22' and 23', an inverting amplifier 24', and three level shifters 25'. The second control circuit 20' performs the same function as the first control circuit 20.

Figure 5:
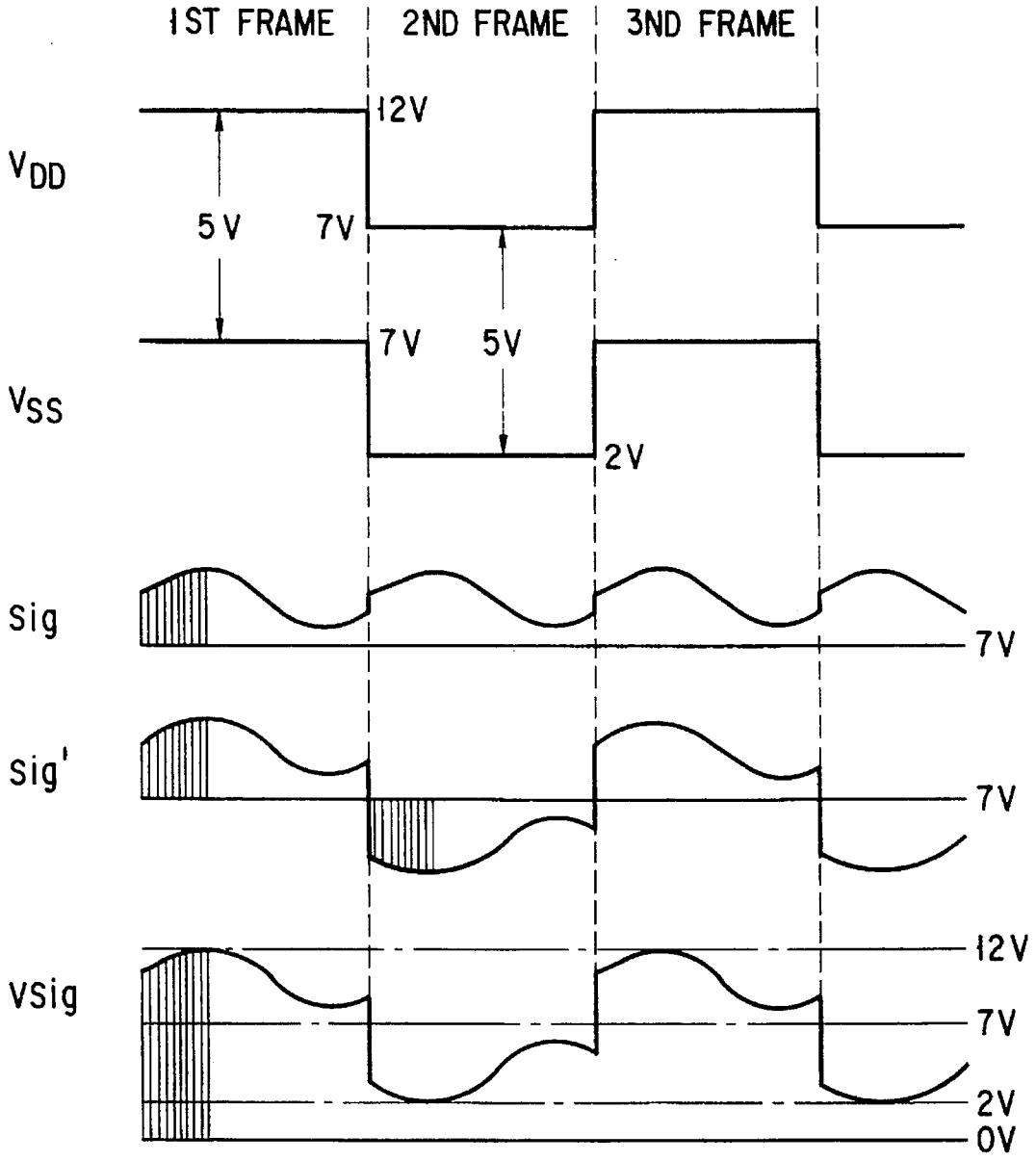
FIG. 5 is a timing chart illustrating the waveforms of the various signals used in the display of FIG. 1, and explaining the operation of the display.

The operation of the active-matrix type liquid-crystal display shown in FIG. 1 will now be explained, with reference to the timing chart of FIG. 5.

Assume a positive voltage is to be applied on the liquid crystal for the odd-numbered frames, and a negative voltage is to be applied on the liquid crystal for the even-numbered frames. In this case, the power-supply potentials VDD and VSS are set at VDD1 and VSS1 for the odd-numbered frame, and the image display signal Sig is supplied directly to the signal-line drive ICs $\mathbf{10}_1$, $\mathbf{10}_3$, . . . $\mathbf{10}_{n-1}$. On the other hand, the power-supply potentials VDD and VSS are set at VDD2 and VSS2 for the even-numbered frame, but the image display signal Sig is inverted by the inverting amplifier 25' (not shown) of the power-supply potential control circuit 20' and then supplied to the signal-line drive ICs $\mathbf{10}_2$, $\mathbf{10}_4$, . . . $\mathbf{10}_n$.

Assume that VDD1=12V, VDD2=7V, VSS1=7V, and VSS2=2V. Then, the power-supply potentials VDD and VSS for the odd-numbered signal-line drive ICs $\mathbf{10}_1$, $\mathbf{10}_3$, . . . $\mathbf{10}_{n-1}$ are 12V and 7V , respectively, and the voltage VSig for the image display signal Sig ranges from 7 to 12V. And, the power-supply potentials VDD and VSS for the even-numbered signal-line drive ICs $\mathbf{10}_{21}$, $\mathbf{10}_4$, . . . $\mathbf{10}_n$ are 7V and 2V, respectively, and the voltage vSig for the image display signal Sig ranges from 2 to 7V. Thus, each signal line D can be fully driven with a voltage of 7V±. In this case, the power-supply voltage for each odd-numbered drive IC is 5V (=VDD1–VSS1), and that for each even-numbered drive IC 10 is also 5V (=VDD2–VSS). Obviously, the power-supply voltage for every signal-line drive IC is lower than the voltage of 12V which is required in the conventional active-matrix type liquid-crystal display.

As has been indicated, it suffices to set the power-supply potentials VDD and VSS of each signal-line drive IC 10 at 12V (=VDD1) and 7V (=VSS1), respectively, in order to apply a positive voltage on the liquid crystal (vSig>the potential of the common electrode, 7V), and to set the power-supply potentials VDD and VSS of each signal-line drive IC 10 at 7V (=VDD2) and 2V (=VSS2), respectively, in order to apply a negative voltage on the liquid crystal (VSig<the potential of the common electrode, 7V). Whether to apply a positive or a negative voltage on the liquid crystal, the power-supply voltage of each signal-line drive IC 10 (i.e., VDD–VSS) is 5V, which is comparatively low.

The moment the levels of the potential VDD and VSS and those of the signals Sig, CONT, CLK and Din are switched, the output terminals of each signal-line drive IC 10 may be set at a potential exceeding the rated power-supply potential range of the IC 10 due to the charge accumulated in the wiring capacitance of each signal line D, inevitably to cause an undesirable operating such as a latch-up. Therefore it is desirable that a protection circuit (e.g., an ordinary type consisting of a diode and a resistor) be connected to each output terminal of the signal-line drive IC 10, thereby to protect the terminal from an excessive voltage.

As has been indicated, the power-supply potentials VDD and VSS of each signal-line drive IC 10 are changed in accordance with the potential of the power-supply potential switching signal (H/L). Each signal-line drive IC 10 can therefore output a voltage higher than its power-supply withstand voltage. In other words, the IC 10 can output a voltage higher than its power-supply voltage by shifting the potentials VDD and VSS, since its power-supply voltage is, in effect, the difference between the power-supply potentials VDD and VSS.

Moreover, since any two adjacent signal lines D are connected to different drive ICs 10, one of these drive ICs 10 can have its power-supply potentials (VDD and VSS) changed by the signal-line inversion method, each potential in the polarity opposite to that of the corresponding power-supply potential of the other drive IC 10. Thanks to the signal-line inversion drive method, the power-supply voltage of either signal-line drive ICs 10 is decreased. In practice, the ICs 10 are 5V-drive ICs each having a low withstand voltage. The use of the 5V-drive ICs enables the liquid-crystal display of FIG. 1 to perform high-definition display because the pixel electrodes 31, though provided in a great number, are driven at a sufficiently high frequency. Also, thanks to the use of the 5V-drive ICs, the liquid-crystal display can be made small and manufactured at low cost. Further, by virtue of the signal-line inversion method performed, an image-quality degradation which may result from the capacitance crosstalk between each signal line and any pixel electrode is prevented, whereby the display displays high-quality images.

In the first embodiment described above, the power-supply potentials VDD and VSS of each signal-line drive IC 10 are changed for each frame of an image. Instead, the potentials VDD and VSS can be changed for every field of the image in the present invention. Further, the analog switches may be replaced by drive amplifiers. Still further, the structure of the signal-line drive ICs 10 may be altered to meet a specification in which to use the active-matrix type liquid-crystal display.

Moreover, the present invention can be applied not only to an active-matrix type liquid-crystal display, but also to a display which is designed for use in combination with an electrostatic printer and which can display an image to be printed, by applying setting the pixel electrodes at different potentials corresponding to the amounts in which to adsorb toner onto those portions of a paper sheet which correspond to the pixel electrodes.

The second embodiment of the invention, which is also an active-matrix type liquid-crystal display, will now be described. This liquid-crystal display is characterized by comprising improved power-supply potential control circuits designed to control digital drive ICs for driving signal lines.

The liquid-crystal display is similar, in structure, to the liquid-crystal display illustrated in FIG. 1. In this display, too, the power-supply potentials VDD and VSS applied from the potential control circuits 20 and 20' are changed between VDD1 and VDD2 and between VSS1 and VSS2, before each frame. The potential VDD output by the control circuit 20 is opposite in polarity to the potential VDD simultaneously output by the control circuit 20'. Likewise, the potential VSS output by the control circuit 20 is opposite in polarity to the potential VSS simultaneously output by the control circuit 20'. The various signals Sig, CONT, CLK, and Din are input to either potential control circuit and changed within the rated potential range of the drive ICs 10.

The control circuits 20 and 20' are of the same structure and characterized by the level shifters 23 each includes. Hence, one of the level shifters 25 of the circuit 20 only will be described, with reference to FIG. 6.

Figure 6:
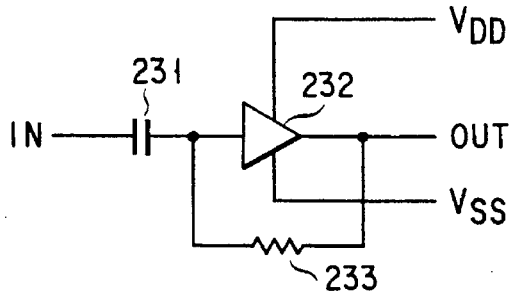
FIG. 6 is a circuit diagram illustrating the level shifter incorporated in the display of FIG. 1.

As shown in FIG. 6, the level shifter 25 comprises 10 a capacitor 231, a buffer amplifier 232, and a feedback resistor 233. The feedback resistor 233 is connected to the input and output terminals of the buffer amplifier 232; the amplifier 232 and the resistor 233 constitute a positive feedback amplifier. Power-supply potentials VDD1 and VSS1 or power-supply potentials VDD2 and VSS2 are applied to the buffer amplifier 232. The capacitor 231 and the feedback resistor 233 constitute a differential circuit, which reproduces only the edge portions of any signal input to the control circuit 20. The buffer amplifier 232 outputs a signal at the low level or the high level in accordance with the level of the input signal as compared with its threshold level of the amplifier 232. Since the amplifier 232 is a CMOS-IC, its threshold level is (VDD+VSS)/2. Since the feedback resistor 233 applies a positive feedback to the buffer amplifier 232, the input of the amplifier 232 is stabilized at the same level as the output thereof.

The positive feedback amplifier comprised of the CMOS buffer amplifier 232 and the feedback resistor 233 may be replaced by a positive feedback amplifier which is constituted by two inverters connected in series. The positive feedback amplifier can be modified or re-designed in any other manner, if necessary.

Figure 7:
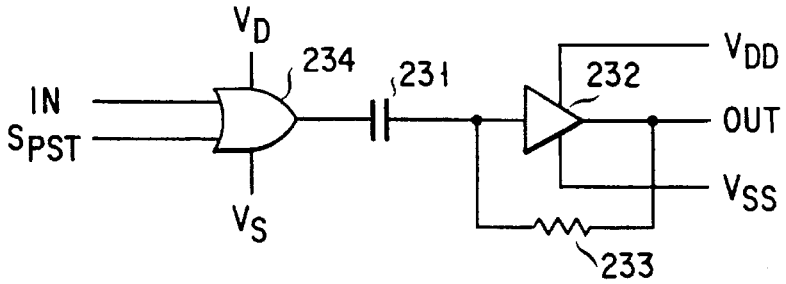
FIG. 7 is a circuit diagram illustrating the level shifter incorporated in a second embodiment of the invention.

The level shifter 25 incorporated in either power-supply potential control circuit, 20 or 20', may be replaced by the one shown in FIG. 7. As can be under stood from FIG. 7, this level shifter is a combination of the level shifter shown in FIG. 6 and an exclusive 0R circuit 234 connected to the input of the level shifter 25. The power-supply potentials $V_D$ and $V_s$ for the exclusive OR circuit 234 can be set at any values, irrespective of the power-supply potentials of the positive feedback amplifier. In this instance, $V_D$=5V and $V_S$=0V, nonetheless. The reset signal $S_{RST}$ supplied to the OR circuit 234 is set at the high level for only the blanking period.

Figure 8A:
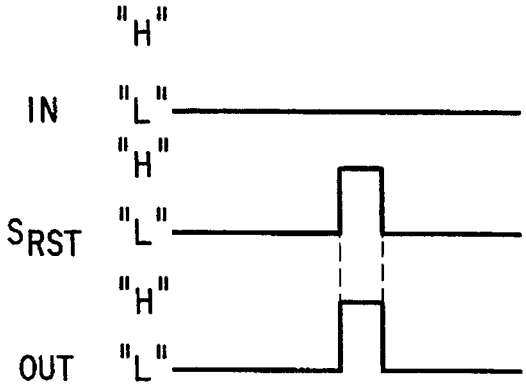
FIGS. 8A and 8B are timing charts showing various signals including a reset signal and a signal output by the power-supply potential control circuit.
Figure 8B:
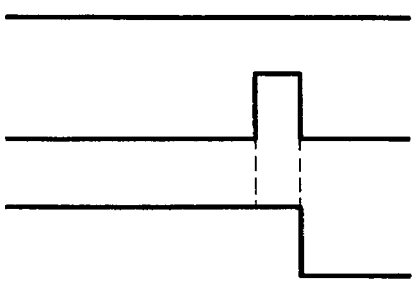

FIGS. 8A and 8B are timing charts representing the relationship which the input signal, the reset signal $S_{RST}$, and the output signal assume in the level shifter 25 shown in FIG. 7. When the input signal is at the same logic level as the output signal of the control circuit 20 before the reset signal $S_{RST}$ is input, the level shifter 25 outputs a signal opposite in level to the input signal, for only the period the reset signal $S_{RST}$ remains at the high level, as is illustrated in FIG. 8A. Conversely, when the input signal is at the logic level opposite to that of the output signal of the control circuit 20 before the reset signal $S_{RST}$ is input, the level shifter 25 outputs a signal which is set at the same logic level as the output signal of the control circuit 20 at the trailing edge of the reset signal $S_{RST}$, as is evident from in FIG. 8B. Thus, the use of the exclusive OR circuit 234 serves to set the input and output signals of the control circuit 20 at the same logic level. In other words, the circuit 20 always outputs correct signals.

The third embodiment of the present invention will now be described, which is designed to prevent a latch-up.

In the first and second embodiments described above, the power-supply potentials VDD and VSS of each signal-line drive IC 10 are changed for each frame (or each field), but each signal line remains at the potential for the previous frame (or the previous field). Inevitably, a voltage higher than the withstand voltage of the drive IC may be applied, thus causing a latch-up. Also, a voltage higher than the withstand voltage may be applied to the drive IC 10, though momentarily, if there is a time lag between the switching of the power-supply potential VDD and that of the power-supply potential VSS. This results in another type of a latch-up. The latch-up of either type may cause an erroneous operation of the drive IC or may destroy the drive IC.

In order to avoid a latch-up of either type, the power-supply potentials VDD and VSS are changed in a specific sequence in the third embodiment. More precisely, the third embodiment includes one of the following two means:

(1) Means for applying, before changing of potentials VDD and VSS from VDD1 and VSS1 to VDD2 and VSS2, respectively, a potential ranging from VDD2 to VSS2 to the signal lines connected to the drive IC 10;

(2) Means for changing potentials VDD and VSS after reducing the power-supply voltage, which is to apply on the drive IC 10, to the difference between the potentials VDD1 and VSS1 (i.e., VDD1 - VSS1) or less.

The liquid-crystal display according to the third embodiment is similar, in structure, to the liquid-crystal display illustrated in FIG. 1. In the third embodiment, the potential of the common electrode is 7V, which is equal to VSS for any odd-numbered frame and equal to VDD for any even-numbered frame. Hence, the output terminals of each signal-drive IC 10 fall within the power-supply potential range of the drive IC 10, provided that the signal lines are set at the common-electrode potential before the power-supply potentials VDD and VSS are changed. In this instance, the potential control circuit 20 (also, the other potential control circuit 20') are designed to input various signals (CONT, CLK, etc.) and the white-level signal (in the case of normal-white display) to each signal-line drive IC 10 during the vertical blanking period. Since no gate signals are input at all, no image can be displayed if the drive IC 10 applies only a white-level potential is applied to each signal line.

If the power-supply potential range from VSSl to VDD1 does not overlap the range from VSS2 to VDD2, the 10 potentials VDD and VSS may be changed several times, respectively from VDD1 to VDD2 or vice versa, and from VSS1 to VSS2 or vice versa. Alternatively, each signal line may be connected to the VDD or VSS source before the potential VDD or VSS is changed, in order to attain the same result.

Figure 9:
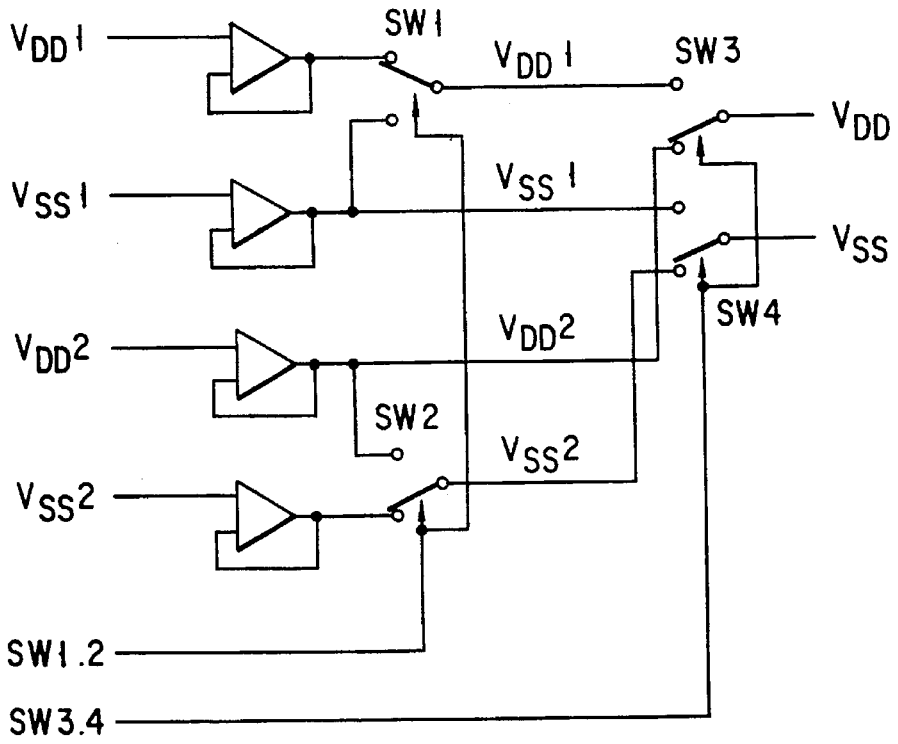
FIG. 9 is a circuit diagram illustrating a power-supply circuit for use in a third embodiment of the present invention.

Another alternative method is to control the timing of changing VDD and VSS by means of such a power-supply circuit as is shown in FIG. 9. The power-supply circuit shown in FIG. 9 comprises switches SW3 and Sw4 which correspond to the switches 21 and 22 and which are used to switch VDD and VSS, respectively. To be more specific, the switch SW1 selects VDD1 or VSS1, and the switch SW2 selects VDD2 or VSS2. In normal condition, the switches SW1 and SW2 select VDD1 and VSS2, respectively, as is illustrated in FIG. 9.

Figure 10:
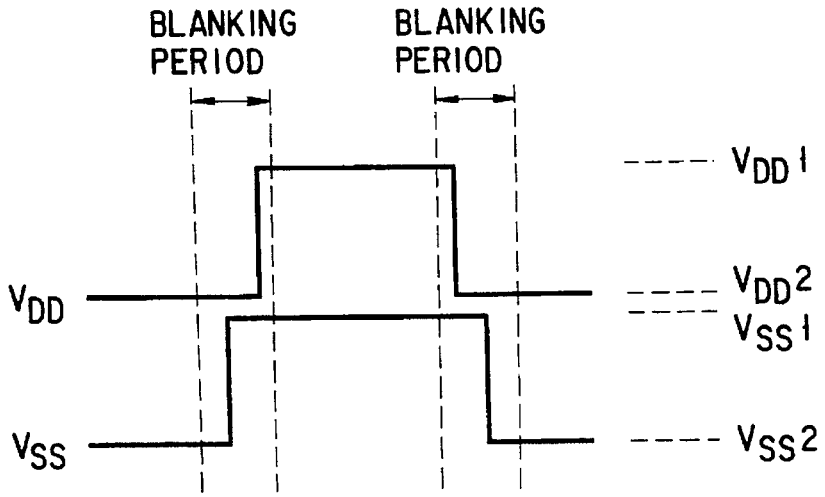
FIG. 10 is a timing chart explaining how power-supply potentials VDD and vSS change.

Assume that the switches SW1 and SW2 select VDD2 and VSS2 as is shown in FIG. 9. Then, VDD changes in the sequence of VDD2, VDD2, VSS1, and VDD1, whereas VSS will change in the sequence of VSS2, VDD2, VSS1, and VSS1—as is illustrated in FIG. 10. In this case, the difference between VDD and VSS varies in the sequence of: (VDD2–VSS2), (VDD2–VDD2), (VSS1–VSS1), and (VDD1–VSS1). Obviously, no voltage higher than the withstand voltage of the drive IC 10 will be applied to the signal-line drive IC 10. The same holds true of the case where VDD1 and VSS1 are changed to VDD2 and VSS2, respectively.

As has been described above, in the present invention, each signal-line drive IC is prevented from making errors or being destroyed, either by setting any signal line connected to the drive IC at a potential before the power-supply potentials VDD and vSS are changed to other potentials VDD and VSS, said potential having a value between the first other potential VSS to the second other potential VDD, or by changing the potentials VDD and VSS applied to the drive IC after the potential of the signal line has been reduced to a value equal to or less than the difference between the initial potentials VDD and VSS.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An active-matrix type display apparatus comprising:

a matrix display panel including a substrate having a major surface, a plurality of pixel electrodes arranged on said substrate in rows and columns, a plurality of signal lines formed on the major surface of said substrate and extending among the columns of said pixel electrodes, a plurality of gate lines formed on the major surface of said substrate, crossing said signal lines and extending among the rows of said pixel electrodes, a plurality of switching elements each connected between a corresponding one of said pixel electrodes and a corresponding one of said signal lines and controlled by a corresponding one of said gate lines, a common electrode opposite to said pixel electrodes and held at a constant potential, and liquid crystal filled between said substrate and said common electrode;

gate-line drive means for applying a gate-drive voltage to each of said gate lines;

power-supply means for generating a first power-supply potential and a second power-supply potential lower than the first power-supply potential, each of the first and second power-supply potentials having respective high and low levels, with the first and second power-supply potentials synchronously varying between their respective high and low levels at predetermined intervals while maintaining a predetermined potential difference therebetween; and signal-line drive means applied by the first power-supply potential and the second power-supply potential to be operated, for applying a signal voltage which is inverted in polarity at the predetermined intervals to each of said signal lines.

2. The display apparatus according to claim 1, wherein said power-supply means generates the first and second power-supply potentials varying between the respective high and low levels for each field or each frame.

3. The display apparatus according to claim 1, wherein said power-supply means generates the first and second power-supply potentials with the low level of the first power-supply potential being set at the high level of the second power-supply potential.

4. The display apparatus according to claim 3, wherein said common electrode is kept at the constant potential equal to the low level of the first power-supply potential and the high level of the second power-supply potential.

5. The display apparatus according to claim 1, wherein said power-supply means includes switching means for switching the first and second power-supply potentials between the high and low levels for each field or each frame.

6. An active-matrix type display apparatus comprising:

a matrix display panel including a substrate having a major surface, a plurality of pixel electrodes arranged on said substrate in rows and columns, a plurality of signal lines having odd-numbered signal lines and even-numbered signal lines which are formed on the major surface of said substrate and extend among the columns of said pixel electrodes, a plurality of gate lines formed on the major surface of said substrate, crossing said signal lines and extending among the rows of said pixel electrodes, a plurality of switching elements each connected between a corresponding one of said pixel electrodes and a corresponding one of said signal lines and controlled by a corresponding one of said gate lines, a common electrode opposite to said pixel electrodes and held at a constant potential, and liquid crystal filled between said substrate and said common electrode;

a gate-line drive circuit for applying a gate-drive voltage to each of said gate lines;

a first power-supply circuit for generating a first power-supply potential and a second power-supply potential lower than the first power-supply potential, each of the first and second power-supply potentials having respective high and low levels, with the first and second power-supply potentials synchronously varying between their respective first and second levels at predetermined intervals while keeping predetermined levels and maintaining a predetermined potential difference therebetween;

a second power-supply circuit for generating a third power-supply potential and a fourth power-supply potential lower than the third power-supply potential, each of the third and fourth power-supply potentials having respective high and low levels, with the third and fourth power-supply potentials synchronously varying between their respective high and low levels at predetermined intervals while keeping predetermined levels and maintaining a predetermined potential difference therebetween, the third and fourth power-supply potentials being inverted in polarity to the first and second power-supply potentials, respectively;

a first signal-line drive circuit connected to said first power-supply circuit and driven by the first power-supply potential and the second power-supply potential, for applying a signal voltage which is inverted in polarity at the predetermined intervals to each of the odd-numbered signal lines; and a second signal-line drive circuit connected to said first power-supply circuit and driven by the third and fourth power-supply potentials, for applying a signal voltage which is inverted in polarity at the predetermined intervals to even-numbered signal lines.

7. The display apparatus according to claim 6, wherein said first power-supply circuit generates the first and second power-supply potentials varying between the respective high and low levels for each field or each frame and said second power-supply circuit generates the third and fourth power-supply potentials varying between the respective high and low levels for each field or each frame.

8. The display apparatus according to claim 6, wherein said first power-supply circuit generates the first and second power-supply potentials with the low level of the first power-supply potential being set at the high level of the second power-supply potential and said second power-supply circuit generates the third and fourth power-supply potentials with the low level of the third power-supply potential being set at the high level of the fourth power-supply potential.

9. The display apparatus according to claim 8, wherein said common electrode is kept at the constant potential equal to the low level of the first power-supply potential and the high level of the second power-supply potential.

10. The display apparatus according to claim 6, wherein each of said first and second power-supply circuits includes a switch circuit for switching the first and second power-supply potentials between the high and low levels for each field or each frame.

11. An active-matrix type display apparatus comprising:

a matrix display panel including a substrate having a major surface, a plurality of pixel electrodes arranged on said substrate in rows and columns, a plurality of signal lines formed on the major surface of said substrate and extending among the columns of said pixel electrodes, a plurality of gate lines formed on the major surface of said substrate, crossing said signal lines and extending among the rows of said pixel electrodes, a plurality of switching elements each connected between a corresponding one of said pixel electrodes and a corresponding one of said signal lines and controlled by a corresponding one of said gate lines, a common electrode opposite to said pixel electrodes, and liquid crystal filled between said substrate and said common electrode;

a plurality of gate-line drive circuits each applying a gate-drive voltage to each of respective ones of said gate lines;

a plurality of power-supply circuits each generating a first power-supply potential and a second power-supply potential lower than the first power-supply potential, each of the first and second power-supply potentials having respective high and low levels, with the first and second power-supply potentials synchronously varying between their respective high and low levels at predetermined intervals while maintaining a predetermined potential difference therebetween; and a plurality of signal-line drive ICs each supplied and operated by the first power-supply potential and the second power-supply potential, for applying a signal voltage which is inverted in polarity at the predetermined intervals to each of said signal lines.

12. The display apparatus according to claim 11, wherein said power-supply circuits each generate the first and second power-supply potentials varying between the respective high and low levels for each field or each frame.

13. The display apparatus according to claim 11, wherein said power-supply circuits each generate the first and second power-supply potentials with the low level of the first power-supply potential being set at the high level of the second power-supply potential.

14. The display apparatus according to claim 13, wherein said common electrode is kept at the constant potential equal to the low level of the first power-supply potential and the high level of the second power-supply potential.

15. The display apparatus according to claim 11, wherein said power-supply circuits each include analog switches for switching the first and second power-supply potentials between the high and low levels for each field or each frame.

* * * * *